US008274022B2

(12) United States Patent
Minoue et al.

(10) Patent No.: US 8,274,022 B2
(45) Date of Patent: Sep. 25, 2012

(54) INDUCTION HEATER AND INDUCTION HEATING METHOD

(75) Inventors: Junji Minoue, Nara (JP); Takehiko Nagao, Osaka (JP)

(73) Assignee: Fuji Electronics Industry Co., Ltd. (JP)

( * ) Notice: Subject to any disclaimer, the term of this patent is extended or adjusted under 35 U.S.C. 154(b) by 413 days.

(21) Appl. No.: 12/653,518

(22) Filed: Dec. 15, 2009

(65) Prior Publication Data

US 2010/0163551 A1 Jul. 1, 2010

(30) Foreign Application Priority Data

Dec. 26, 2008 (JP) ..... 2008-334046

(51) Int. Cl.
*H05B 6/12* (2006.01)
*H05B 6/10* (2006.01)

(52) U.S. Cl. ..... 219/624; 219/639

(58) Field of Classification Search ..... 219/624, 219/674, 639, 652

See application file for complete search history.

(56) References Cited

FOREIGN PATENT DOCUMENTS

JP 2000-087135 * 3/2000
JP 2000-087135 A 3/2000

* cited by examiner

*Primary Examiner* — Calvin Lee
(74) *Attorney, Agent, or Firm* — Wood, Phillips, Katz, Clark & Mortimer

(57) ABSTRACT

An object of the present invention is to provide an induction heater and an induction heating method capable of heating by induction a work in which a gear portion and a shaft are integrated.

An induction heater for a gear portion and a stepped shaft is arranged in such a manner that a first heating coil (annular coil) surrounds the gear portion and that a second heating coil (linear coil) faces the stepped shaft in an axial direction. Alternating currents of different frequencies are supplied to the first heating coil 1 and the second heating coil. Further, a part of the second heating coil is arranged so as to come opposite a boundary between the gear portion and the stepped shaft, thereby connecting a hardened pattern of the gear portion by the first heating coil and a hardened pattern of the stepped shaft by the second heating coil.

16 Claims, 9 Drawing Sheets

INDUCTION HEATER AND INDUCTION HEATING METHOD

BACKGROUND OF THE INVENTION

1. Field of the Invention

The present invention relates to induction heaters, more specifically to an induction heater and an induction heating method for heating by induction a work in which a gear portion and a shaft are integrated.

Simultaneously, the present invention relates to an induction heater and an induction heating method for heating by induction a work having a gear portion and a stepped shaft.

2. Description of the Related Art

Conventional induction heaters employ various forms of heating coils corresponding to shapes of objects to be heated by induction. A patent document 1 specified below proposes a heating coil having a form applicable to heat by induction a shaft having different diameters. Specifically, a connecting part between a small-diameter part and a large-diameter part is difficult to be appropriately heated (hardened) by induction although being readily subjected to stress. However, the induction heater as disclosed in the patent document 1 efficiently hardens the connecting part.

Patent Document 1: JP 2000-87135 A

SUMMARY OF THE INVENTION

Problem to be Solved by the Invention

The induction heater disclosed in the patent document 1 is unusable for hardening of a gear with a relatively long shaft used for a device such as a reducer.

A device such as a worm gear reducer or a reducer including an epicyclic gear train sometimes uses a gear in which a gear portion and a shaft are integrated as shown in FIGS. 12 and 13.

Such a gear has a relatively big step between a gear portion 100 and a shaft 101.

Further, the shaft 101 often includes one or more steps in order to define a potion to be supported by a shaft bearing or a portion to be engaged with other components.

On the other hand, the induction heater disclosed in the patent document 1 may be applied only to an object to be heated having only one connecting part (step), besides has a difficulty in uniformly heating a work having a big step. That means, the induction heater disclosed in the patent document 1 cannot respond to an object to be heated having more than two different-diameter portions. Such an object to be heated includes, as described above, a pinion used for a device such as a reducer. A pinion includes not only a shaft but also a gear portion for transmitting power. Thus, recently, a development of an induction heater adapted to heat by induction simultaneously a gear portion and a shaft has been required. Especially, in a pinion shaft provided with a gear portion at only one end, a stepped portion (a boundary between a gear portion and a shaft) undergoes stress concentration. Thus, it is essential to form a uniform hardened layer on the stepped portion.

Taking into account with the above-mentioned problem of the art, the present invention therefore aims to provide an induction heater and an induction heating method capable of executing efficient heat treatment of a work in which a gear portion and a shaft are integrated.

Simultaneously, the present invention aims to provide an induction heater and an induction heating method capable of simultaneously heating by induction a gear portion and a stepped shaft included in an object such as a pinion with a different-diameter shaft so as to form a continuous hardened layer at a boundary between the gear portion and the stepped shaft.

Means to Solve the Problem

An aspect of the present invention proposed herein to solve the above-mentioned problem is an induction heater for heating a work having a gear portion and a shaft, including a first heating coil having an arc-shaped portion arranged so as to surround the gear portion and a second heating coil being arranged so as to face the shaft and having a length in an axial direction of the shaft, and being adapted to supply an alternating current to the first and second heating coils.

The work to be heated may have a step.

For example, the work to be heated may have a step between the gear portion and the shaft and/or a step on the shaft.

It is preferable to supply alternating currents of different frequencies to the first heating coil and to the second heating coil.

More preferably, the frequency of the alternating current supplied to the first heating coil and the frequency of the alternating current supplied to the second heating coil are different enough to suppress vibration caused by interference.

The first heating coil may be a semiopen coil such as a saddle-shaped coil, but it is proposed to employ an annular coil as the first heating coil.

Preferably, the second heating coil is a so-called linear coil, which has a plurality of linear parts and a connecting part connecting the linear parts in series by their ends, the linear parts being either straight or lightning-shaped.

Preferably, the work to be heated has a step and the connecting part of the second heating coil is of an arc shape and is arranged so as to come opposite the step.

It is proposed that the connecting part has a quadrangular cross section and includes a planar face facing to a corner at the back of the step.

The linear parts of the second heating coil each may have a quadrangular cross section and the connecting part of the second heating coil may have a quadrangular cross section and be twisted relative to the linear parts.

Preferably, the induction heater further includes a rotating means for rotating the work.

A more specific configuration involved in the present invention is an induction heater for heating a work having a gear portion, a shaft, and a step between the gear portion and the shaft, including a first heating coil of an annular shape and arranged so as to surround the gear portion and a second heating coil being arranged so as to face the shaft and having a length in an axial direction of the shaft, wherein the first heating coil is an annular coil, wherein the second heating coil has a plurality of linear parts and a connecting part connecting the linear parts in series by their ends, the linear parts being either straight or lightning-shaped, the connecting part being of an arc shape and being arranged so as to come opposite the step, and being adapted to supply a high-frequency current simultaneously to the first and second heating coils, wherein a frequency of the high-frequency current supplied to the first heating coil and a frequency of the high-frequency current supplied to the second heating coil are different enough to suppress vibration caused by interference.

Further, another aspect of the present invention is an induction heating method for heating a work having a gear portion and a shaft, including the steps of positioning an annular coil to surround the gear portion, positioning a linear coil to be close to the shaft, and supplying a high-frequency current simultaneously to the annular coil and the linear coil, so as to generate an induction current in the work.

It is preferable to supply high-frequency currents of different frequencies to the annular coil and to the linear coil.

It is preferable that the frequency of the high-frequency current supplied to the annular coil and the frequency of the high-frequency current supplied to the linear coil are different enough to suppress vibration caused by interference.

It is preferable to heat the work by induction with rotating the work.

Another recommended configuration involved in the present invention is an induction heater for a work having a gear portion and a stepped shaft, including an annular coil surrounding the gear portion and a linear coil arranged to face the stepped shaft in an axial direction, and being adapted to supply alternating currents of different frequencies to the annular coil and to the linear coil.

The present aspect includes an annular coil (first heating coil) surrounding the gear portion and a linear coil (second heating coil) arranged to face the stepped shaft in an axial direction. By this configuration, the annular coil ensures an induction current flow from a tooth tip to a dedendum of the gear portion and further from the dedendum to an adjacent tooth tip, thereby forming a hardening having a uniform depth on a tooth surface. Simultaneously, the linear coil ensures an induction current flow along the axial direction of the stepped shaft, thereby forming a hardening having a uniform depth on a surface of a different-diameter shaft.

More specifically, when an induction current is generated in a work by supply of an alternating current to a coil, the induction current flows in a direction parallel to a coil winding direction.

Herein, the present aspect arranges a coil (first heating coil) having an arc-shaped face around the gear portion, so that a winding of the first heating coil annually surrounds the gear portion. By this configuration, an induction current flows from a tooth tip to a dedendum of the gear portion and further from the dedendum to an adjacent tooth tip. That forms a hardening having a uniform depth on a tooth surface.

Further, the present aspect uses a linear coil (second heating coil) to heat the shaft by induction, so that an induction current flows along the axial direction of the shaft.

Thus, even if the shaft has a step, the induction current flows through the step, thereby connecting heated portions at the step.

Consequently, even if a stepped shaft has lots of different-diameter portions, there is provided the linear coil designed to be arranged along the axial direction of the stepped shaft, so that an induction current flows along the axial direction of the stepped shaft, thereby forming a hardening having a uniform depth on a tooth surface of the stepped shaft.

Further, alternating currents having different frequencies supplied to the annular coil and to the linear coil prevent an induction current generated in a pinion by the annular coil and an induction current generated by the linear coil from interfering with each other. That ensures formation of a continuous hardened layer at the boundary between the gear portion and the shaft.

Additional explanation will be described below to make this point clear.

Simultaneous supply of an alternating current to different kinds of coils may cause interference of a current flowing in the coils or an induction current generated in a work with each other, resulting in vibration in those. That means, currents such as the alternating current makes a beat.

Such vibration is caused by slight drift between two frequencies of alternating currents. In other words, in a case of a plurality of coils arranged closely each other, supply of an alternating current of the same frequency to the coils might give rise to a resonance, but not cause vibration. However, in a process of heat treatment, the coils might be affected by conditions such as crystal structure change of a work, resulting in frequency drift of the alternating current flowing in one of the coils.

Such slight frequency drift of the alternating current flowing in the coil might cause vibration of a current value of the alternating current in terms of time. The smaller the difference between the frequencies of the alternating currents flowing in the coils is, the larger a time cycle and an oscillation amplitude of this vibration become.

Consequently, a certain degree of difference between the frequencies of the alternating currents flowing in the coils suppresses vibration.

It is further preferable that a part of the linear coil is arranged to face a boundary between the stepped shaft and the gear portion.

In this aspect, a part of the linear coil is arranged to face the boundary between the stepped shaft and the gear portion, thereby heating the boundary by induction by the linear coil. That keeps sufficient strength of the boundary (step of the shaft continuous to a bottom of teeth) that easily undergoes stress concentration when a load is applied in using of a gear.

It is preferable to connect a hardened pattern of the gear portion by the annular coil and a hardened pattern of the stepped shaft by the linear coil by using the induction heater as described above.

Embodiment of this aspect provides continuous formation of a hardened pattern of the gear portion and a hardened pattern of the shaft. That ensures formation of a continuous hardened layer at the boundary between the gear portion and the stepped shaft, thereby obtaining the gear portion and the stepped shaft of high quality.

Advantageous Effect of the Invention

Embodiment of the present invention provides a good induction heating of a gear without blocking an induction current generated at each part of a gear portion and a stepped shaft.

DESCRIPTION OF THE PREFERRED EMBODIMENT

Figure 1:
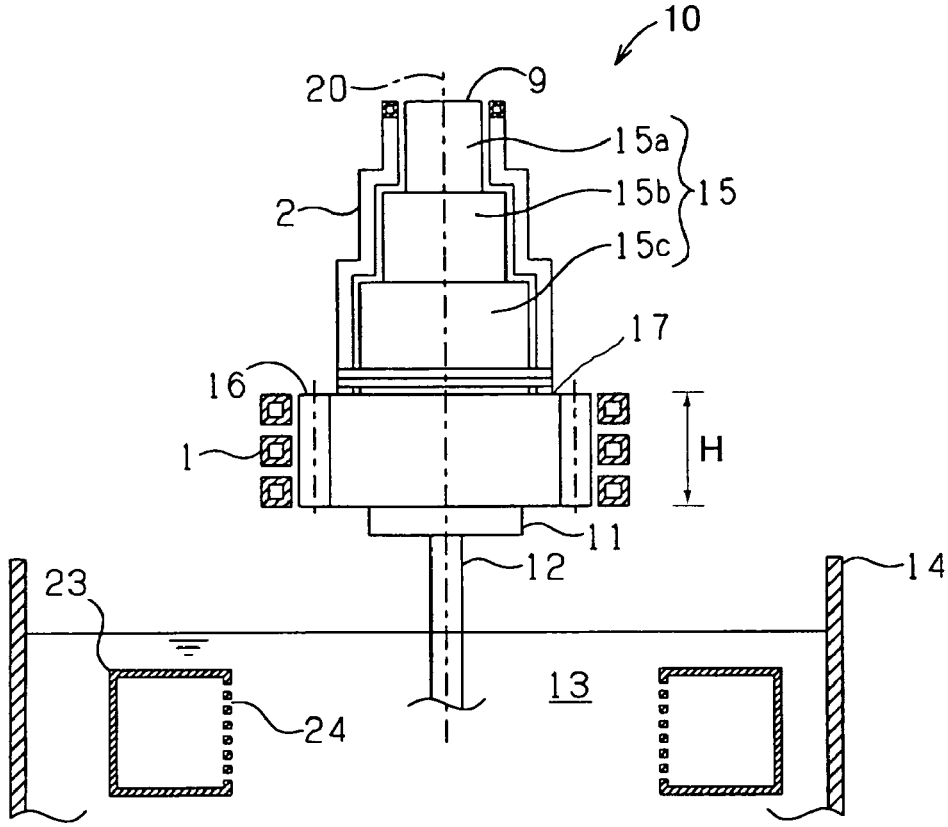
FIG. 1 is a cross section of heating coils for an induction heater embodying the present invention and of a pinion (a gear portion and a stepped shaft) having a different-diameter shaft.

Now, a preferred embodiment of the present invention will be described in detail below, making reference to the accompanying drawings. An induction heater 10 in the present invention is specifically a high-frequency hardening device. A work 9 to be heated by the induction heater 10 in the present invention includes a shaft (stepped shaft) 15 and a gear portion 16. The shaft 15 consists of a small diameter part 15*a*, a medium diameter part 15*b*, and a large diameter part 15*c*. The gear portion 16 has a predetermined module (4.5~16).

The work 9 is made by cutting a piece of steel, further including a first step 30 between the gear portion 16 and the shaft 15, a second step 31 between the large diameter part 15*c* and the medium diameter part 15*b*, and a third step 32 between the medium diameter part 15*b* and the small diameter part 15*a*.

Figure 3:
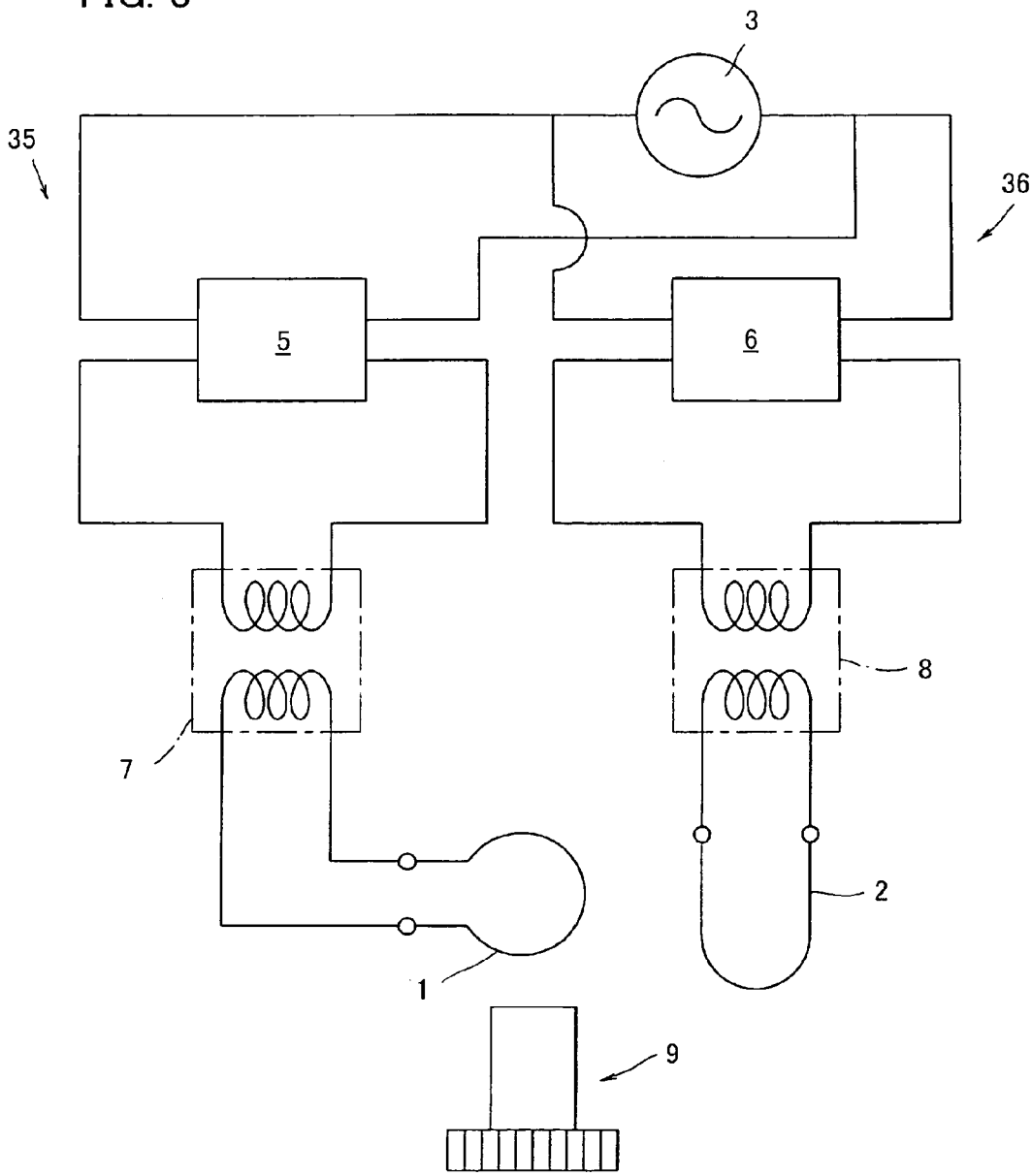
FIG. 3 is a wiring diagram of the induction heater embodying the present invention.

The induction heater 10 includes a first heating coil 1 and a second heating coil 2, the former being an annular coil and the latter being a linear coil. Referring to FIG. 3, the first heating coil 1 and the second heating coil 2 have their respective power circuits 35 and 36.

More specifically, the induction heater 10 in this embodiment has the discrete dual-system power circuits 35 and 36. The circuit 35 includes a frequency converter (high-frequency oscillator) 5 and a transformer 7, whereas the circuit 36 includes a frequency converter (high-frequency oscillator) 6 and a transformer 8.

Thereby, high-frequency currents of different frequencies are supplied to the first and second heating coils 1 and 2 respectively.

As described above, the present embodiment uses two heating coils: one is an annular coil, which is the first heating coil 1; and the other is a linear coil, which is the second heating coil 2.

The first heating coil 1 consists of several turns with a diameter slightly larger than an outer diameter of the gear portion 16 of the work 9 and a height H substantially equal to a face width of the gear portion 16. Thus, the first heating coil 1 is annularly arranged around an outside of the gear portion 16 so as to allow an inner peripheral part of the coil 1 to face the gear portion 16.

Figure 8:
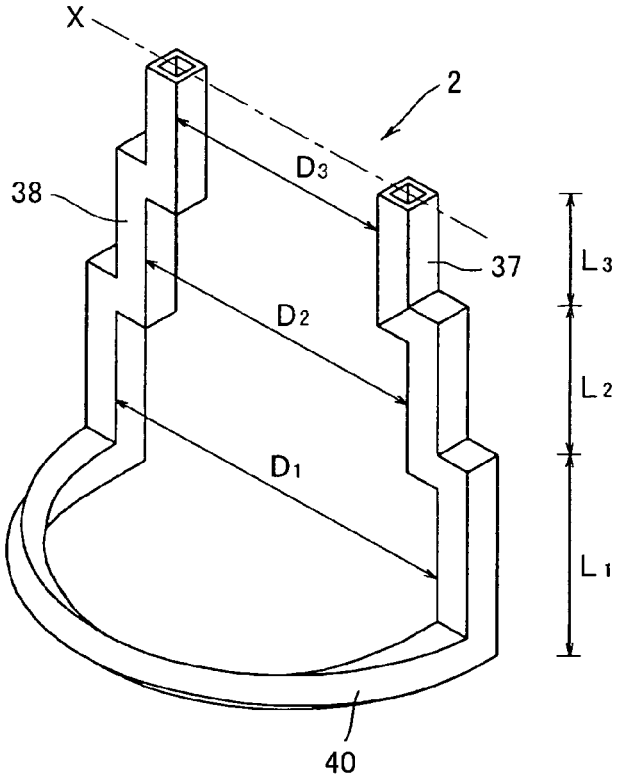
FIG. 8 is a perspective view of the second heating coil shown in FIG. 1.

The second heating coil 2, as shown in FIG. 8, consists of two linear parts 37 and 38 and a connecting part 40.

The linear parts 37 and 38 each have a pipe-like shape with a quadrangular cross section and have a length in an axial direction, forming a lightning shape including three straight parts as shown in FIG. 8.

The connecting part 40 also has a pipe-like shape of a quadrangular cross section and has an arc shape.

The connecting part 40 connects the linear parts 37 and 38 in series by their ends, thereby fixing the linear parts 37 and 38 substantially in parallel.

Further, as described above, the linear parts 37 and 38 of the second heating coil 2 each has three straight parts, thus having three levels of width between the linear parts 37 and 38 according to positions.

Specifically, a width D1 at a position proximal to the connecting part 40 is broadest, a width D3 at a position distal to the connecting par 40 is narrowest, and a width D2 between the widths D1 and D3 has a medium width of those.

The width D1 is slightly larger than a diameter of the large diameter part 15*c* of the work 9, the width D2 is slightly larger than a diameter of the medium diameter part 15*b* thereof, and the width D1 is slightly larger than a diameter of the small diameter part 15*a* thereof.

The linear parts 37 and 38 of the second heating coil 2 each have three levels of heights. A height L1 at a position corresponding to the width D1 is substantially equal to a length of the large diameter part 15*c* of the work 9, a height L2 at a position corresponding to the width D2 is substantially equal to a length of the medium diameter part 15*b* thereof, and a height L3 at a position corresponding to the width D3 is substantially equal to a length of the small diameter part 15*a* thereof.

Further, the linear parts 37 and 38 each have the above-mentioned quadrangular cross section, which includes two sides parallel to an imaginary line X connecting the linear parts 37 and 38. Meanwhile, the connecting part 40 is twisted relative to the linear parts 37 and 38.

Figure 2:
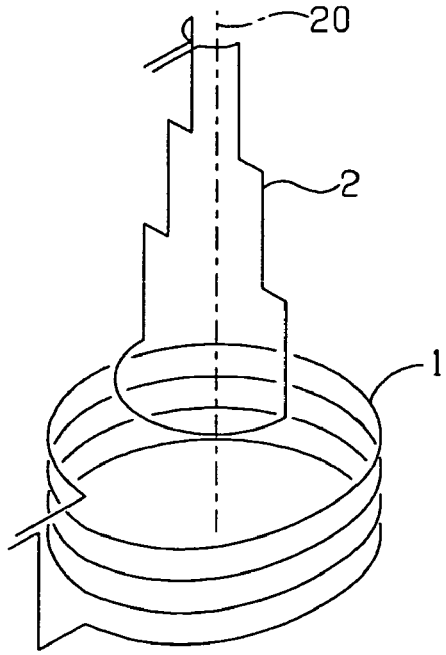
FIG. 2 is a perspective view of the heating coils for the induction heater embodying the present invention.

As shown in FIGS. 1 and 2, in the induction heater 10 in this embodiment, the second heating coil 2 is arranged above the first heating coil 1. In heating by induction, the induction heater 10 is arranged so that the second heating coil 2 faces the shaft 15 of the work 9 and that the first heating coil 1 surrounds the gear portion 16 thereof. The first and second heating coils 1 and 2 are close to each other. The first and second heating coils 1 and 2 each are designed to move up and down or right and left by a moving device not shown. Specifically, the moving devices move the first and second heating coils 1 and 2, so as to align a center of the first heating coil 1 and a center of the second heating coil 2 to a rotational center 20 (center of the work 9), which is shown by a dashed line in FIGS. 1 and 2, as precisely as possible.

The induction heater 10 is provided with a lifting table 11 for lifting up and down the work 9 mounted thereon. The lifting table 11 is supported by a supporting shaft 12 adapted to rotate by a motor not shown. The supporting shaft 12 moves up and down with the lifting table 11 by means of a lifting device (not shown) arranged within a coolant tank 14. Rotation of the supporting shaft 12 rotates the work 9 mounted on the lifting table 11.

The induction heater 10 is further provided with the coolant tank 14 containing liquid coolant 13. The work 9 having been heated to high temperature is immersed in the coolant 13 so as to be cooled. The coolant tank 14 shown in FIG. 1 has an injector 23, which is either an annular injector or an opposing pair of injector units, with a number of coolant injection orifices 24 at an inner side of the injector 23. The work 9 is arranged within an area surrounded by the injector 23. In order to cool the work 9 after induction heating, the work 9 is immersed in the coolant 13 in the coolant tank 14, simultaneously the coolant 13 being injected to the work 9 from the injection orifices 24.

The above-mentioned first and second heating coils 1 and 2 are located over liquid surface of the coolant 13, so that the work 9 mounted on the lifting table 11 is lifted up and faces the both heating coils 1 and 2 so as to be ready to be heated when being heated, and that the work 9 is lifted down to be immersed in the coolant 13 when being rapidly cooled after induction heating.

Now, electrical circuits of the first heating coil (annular coil) 1 and the second heating coil (linear coil) 2 will be described in detail below.

The first heating coil 1 and the second heating coil 2 are independent of each other and are not electrically connected. The first heating coil 1 is connected to a power source (commercial power source) 3, the frequency converter (high-frequency oscillator) 5, and the transformer (electrical converter) 7. Frequency (50 Hz or 60 Hz) of an alternating current supplied from the power source 3 is converted to a predetermined first frequency by the frequency converter 5 and further converted to a predetermined voltage by the transformer 7, so as to be supplied to the first heating coil 1.

Meanwhile, the second heating coil 2 is connected to the power source (commercial power source) 3, the frequency converter (high-frequency oscillator) 6, and the transformer (electrical converter) 8. The frequency (50 Hz or 60 Hz) of the alternating current supplied from the power source 3 is converted to a predetermined second frequency by the frequency converter 6 and further converted to a predetermined voltage by the transformer 8, so as to be supplied to the second heating coil 2.

The first frequency of the alternating current (high-frequency current) supplied to the first heating coil 1 is different from the second frequency of the alternating current (high-frequency current) supplied to the second heating coil 2. That suppresses vibration in currents such as the high-frequency current generated by the first heating coil 1, the high-frequency current generated by the second heating coil 2, and an induction current generated in the work 9 at a boundary 17 between the shaft 15 and the gear portion 16 of the work 9.

In other words, the use of two different heating coils so as to discretely supply induction currents of different frequencies prevents impaired induction heating of the boundary 17 resulting from interference of the induction currents at the boundary 17 of the work 9.

Preferred settings of the first and second frequencies depend on a shape and a size of the work 9. More specifically, conditions such as a module, a size of teeth, and a diameter of a dedendum circle of the gear portion 16, and a diameter of the shaft 15 determine appropriate first and second frequencies.

Though the first and second frequencies are made different enough to suppress vibration caused by interference, it is preferable to allow a difference larger than possible variation of the frequencies in consideration of stability of the frequencies converted by the frequency converters (high-frequency oscillation) 5 and 6 because slight drift between the first and second frequencies generates vibration as described above.

Further, a difference between the first and second frequencies may be set wider because more than a certain level of difference therebetween avoids generation of vibration. For example, the first frequency and the second frequency may differ from each other by about 5% to 50%.

Figure 9:
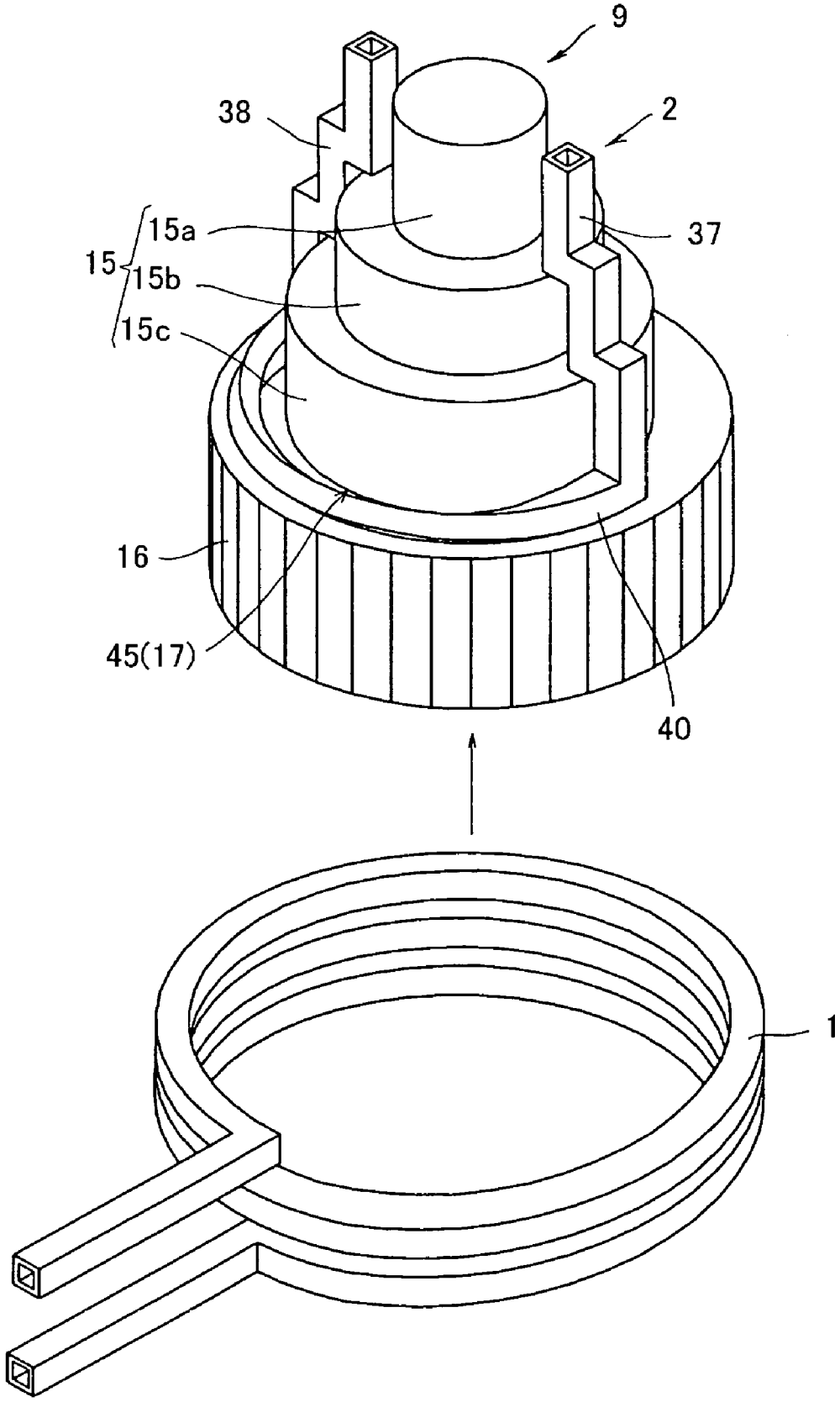
FIG. 9 is a perspective view showing a relationship between the heating coils and the pinion (a gear portion and a stepped shaft) having a different-diameter shaft when the second heating coil (linear coil) is mounted on the pinion and a first heating coil is made closer to the pinion.
Figure 10:
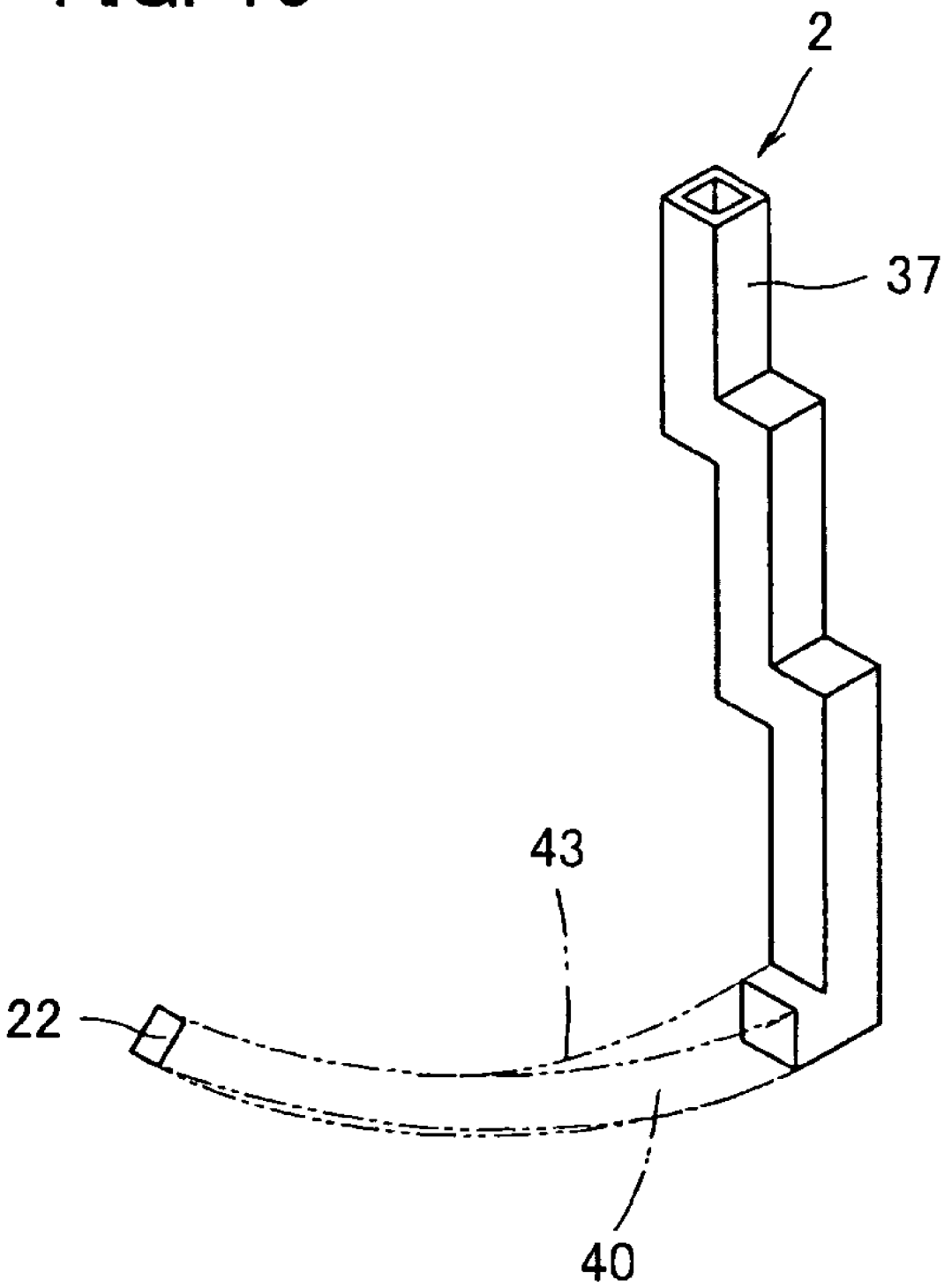
FIG. 10 is a partially cross-sectional perspective view of the arc-shaped portion of the second heating coil.

In this embodiment, as shown in FIGS. 1 and 9, a high-frequency current is simultaneously supplied to the heating coils 1 and 2, which are arranged so as to surround the work 9, thereby heating the work 9. In heating of the work 9, the work 9 is rotated. Upon completion of induction heating, the work 9 is lifted down to be immersed into the coolant tank 14, so as to be hardened by rapid cooling.

Figure 4:
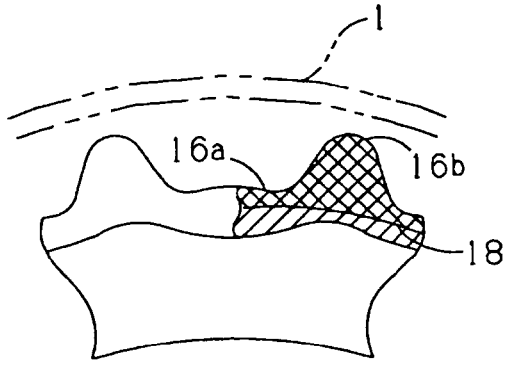
FIG. 4 is a cross-sectional view of a gear portion of a work heated by the induction heater of the present invention.
Figure 5:
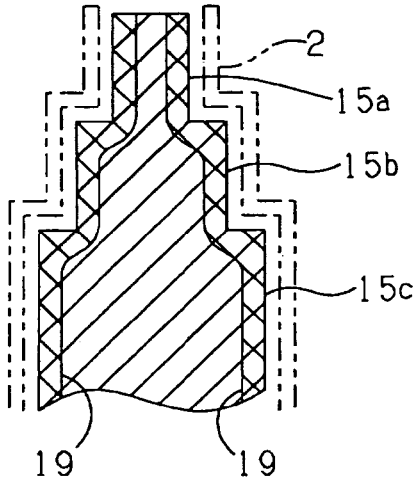
FIG. 5 is a cross-sectional view of a shaft of the work heated by the induction heater of the present invention.

As a consequence of induction heating of the work 9 by the first and second heating coils 1 and 2, the gear portion 16 and the shaft 15 of the work 9 are subjected to hardening as shown in FIGS. 4 and 5. FIG. 4 is a partially cross-sectional view of the gear portion 16 of the work 9 and FIG. 5 is a partially cross-sectional view of the shaft 15 of the work 9.

More specifically, as a consequence of induction heating of the work 9 by the induction heater 10, the gear portion 16 is subjected to hardening (a downside hatched portion) from a dedendum 16*a* to a tooth tip 16*b* as shown by a hardened line 18 in FIG. 4, while the shaft 15 is subjected to hardening (a downside hatched portion) having a substantially uniform depth from the small diameter part 15*a* thorough the medium diameter part 15*b* to the large diameter part 15*c* as shown by a hardened line 19 in FIG. 5.

Figure 6:
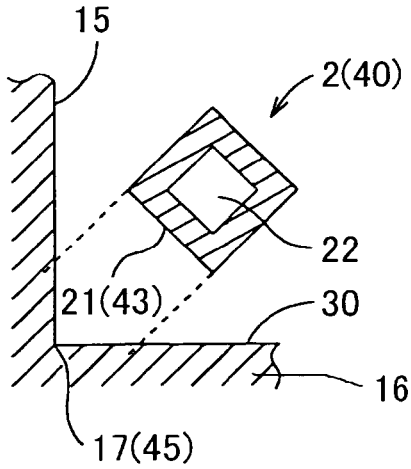
FIG. 6 is a cross-sectional view of an arc-shaped portion of a second heating coil (linear coil) and of a part of the work.

Further, the boundary 17 between the gear portion 16 and the shaft 15 is heated by induction by an arc-shaped portion of the second heating coil 2 arranged opposite the boundary 17. FIG. 6 is a cross-sectional view of the arc-shaped portion of the second heating coil 2 and of a part of the work 9. As shown in FIG. 6, the second heating coil 2 has a quadrangular cross section, defining a cavity 22 through which water flows. The connecting part 40 is, as described above, twisted relative to the linear parts 37 and 38, so that one planar face 43 of the quadrangular cross section of the connecting part 40 of the second heating coil 2 constitutes an opposite face 21 coming opposite the boundary 17. In short, the planar face 43 is designed to face to a corner 45 at the back of the first step 30.

Consequently, an area shown by a dashed line beginning from the opposite face 21 is where an induction current flows easily. Thus, the boundary 17 is heated well by induction. In an example shown in FIG. 6, though the opposite face 21 is inclined at 45 degrees relative to the gear portion 16 and the shaft 15, an inclination angle may be set discretionarily. Especially, in a case where a protruding portion exists in the vicinity of the boundary 17, higher heat capacity is required accordingly. Therefore, it is preferable to expose the opposite face 21 to the protruding portion.

The present invention is constituted in such a manner that the first heating coil (annular coil) 1 is arranged around the gear portion 16 of the work 9 and that the second heating coil (linear coil) 2 is arranged close to the shaft 15. According to such a configuration, induction heating while rotating the work 9 provides hardening of a substantially uniform depth to the gear portion 16 and the shaft 15 by the first and second heating coils 1 and 2.

Further, the respective supply of high-frequency alternating currents of different frequencies to the first heating coil (annular coil) 1 and the second heating coil (linear coil) 2 and the arrangement of a part of the second heating coil 2 so as to come opposite the boundary 17 between the gear portion 16 and the shaft 15 form a continuous hardened pattern on the boundary (portion to undergo stress concentration) 17.

The present invention produces an effect more remarkably, especially when being embodied in a pinion with teeth having a relatively large module (4.5~16).

Figure 7:
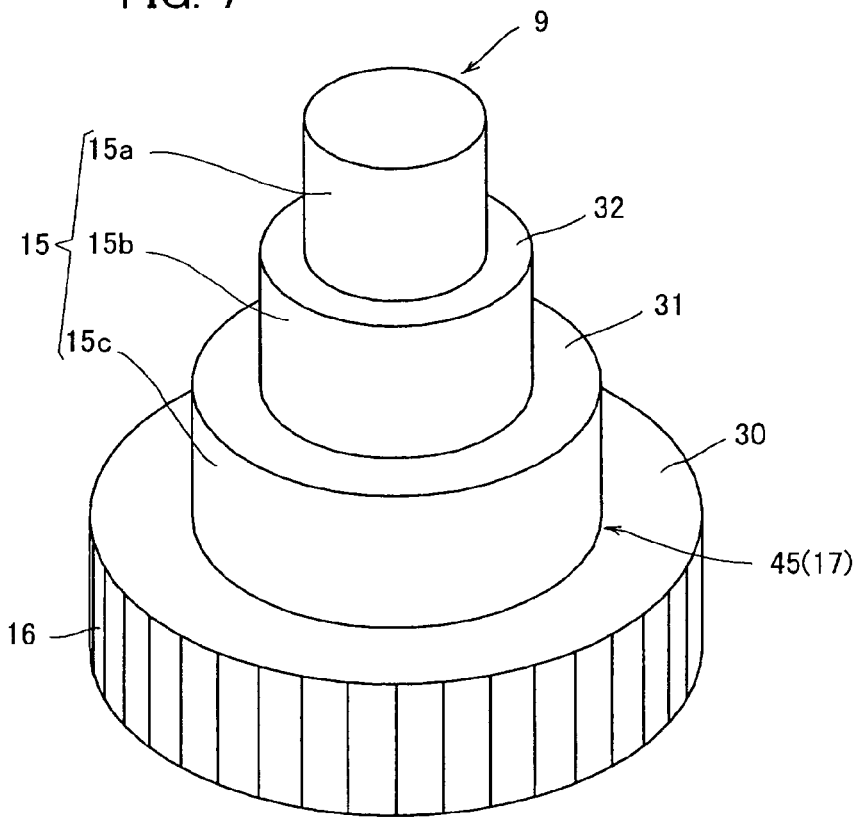
FIG. 7 is a perspective view of the pinion shown in FIG. 1.
Figure 11:
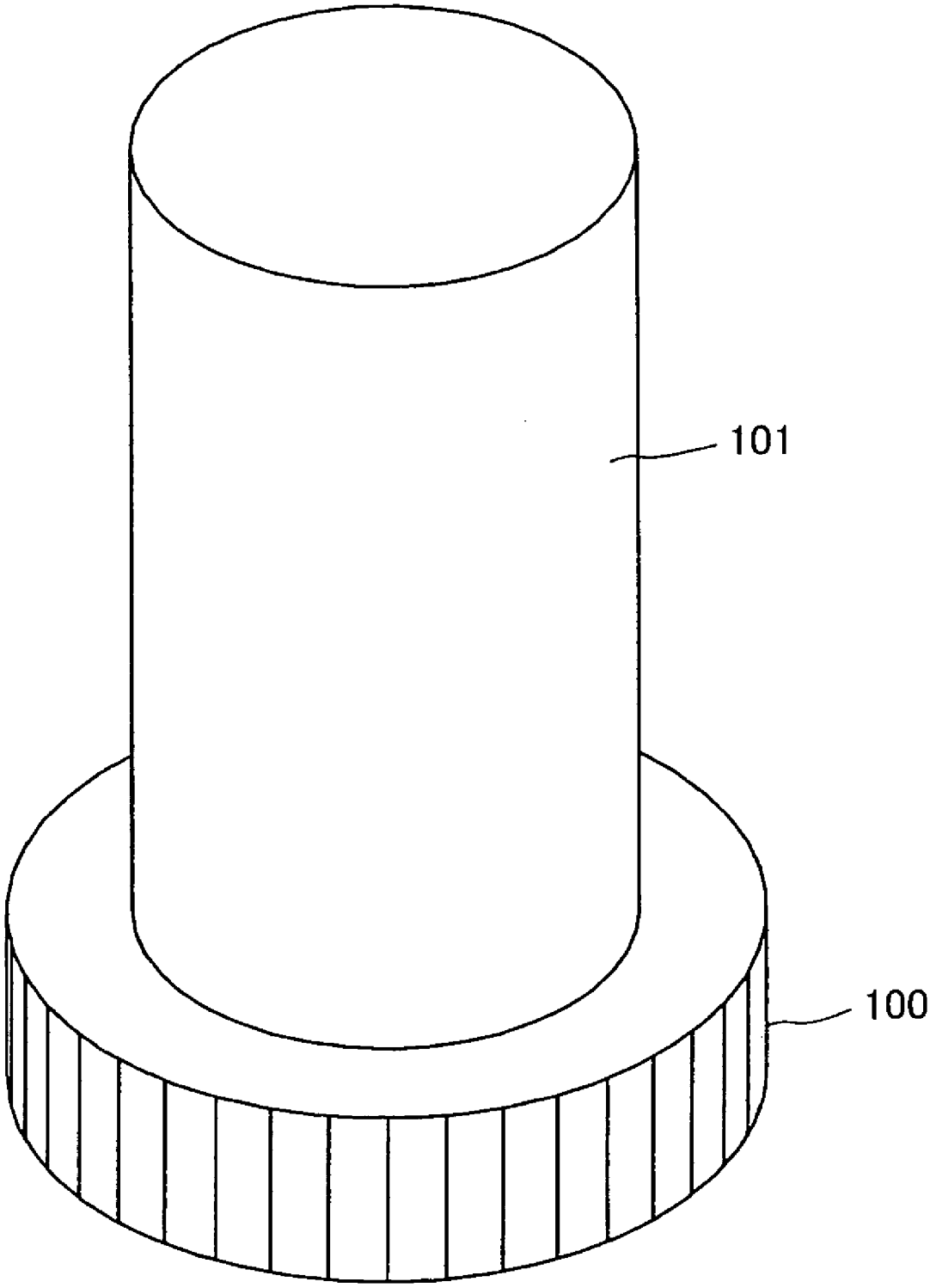
FIG. 11 is a perspective view of a modified embodiment of the work.
Figure 12:
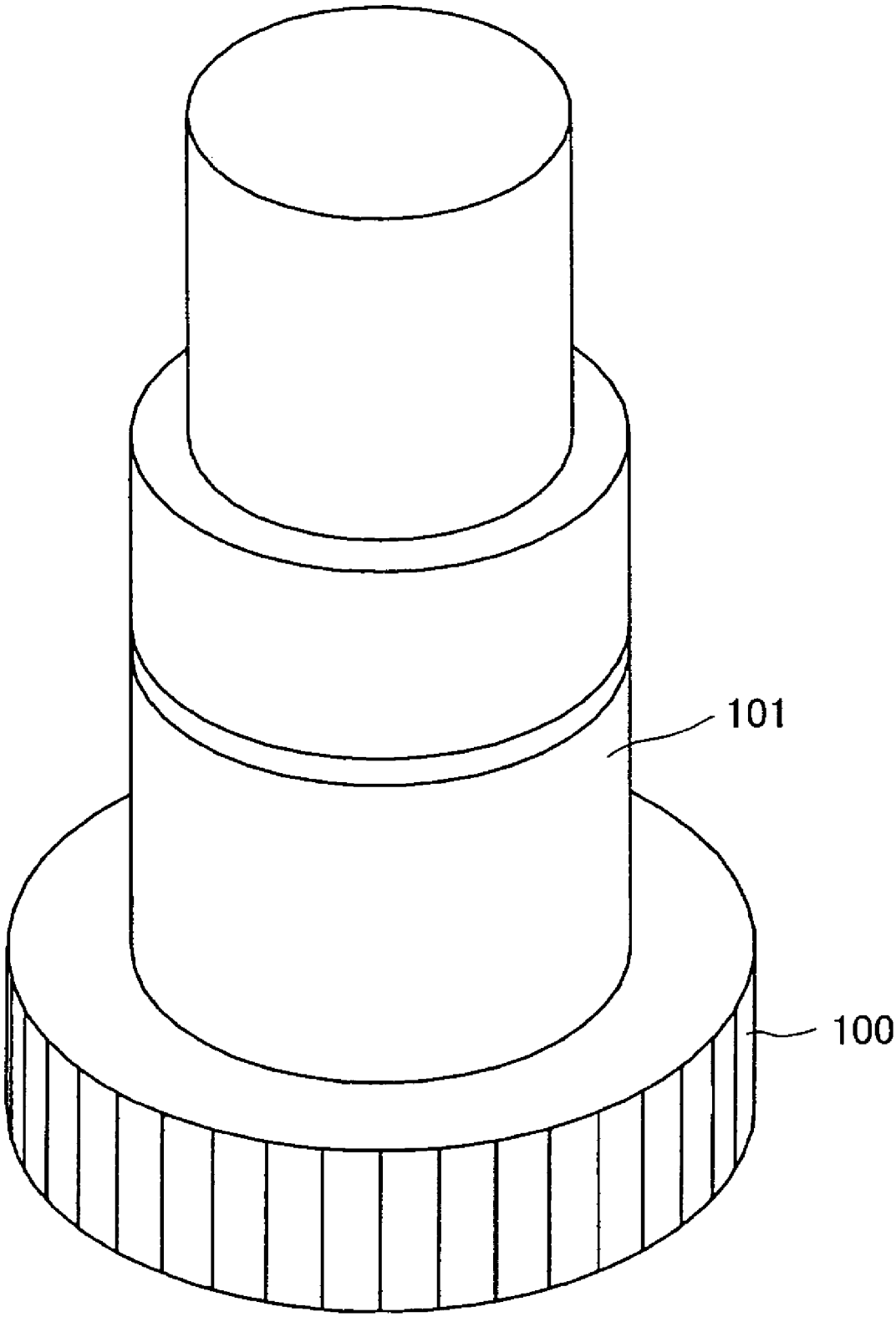
FIG. 12 is a perspective view of another modified embodiment of the work.
Figure 13:
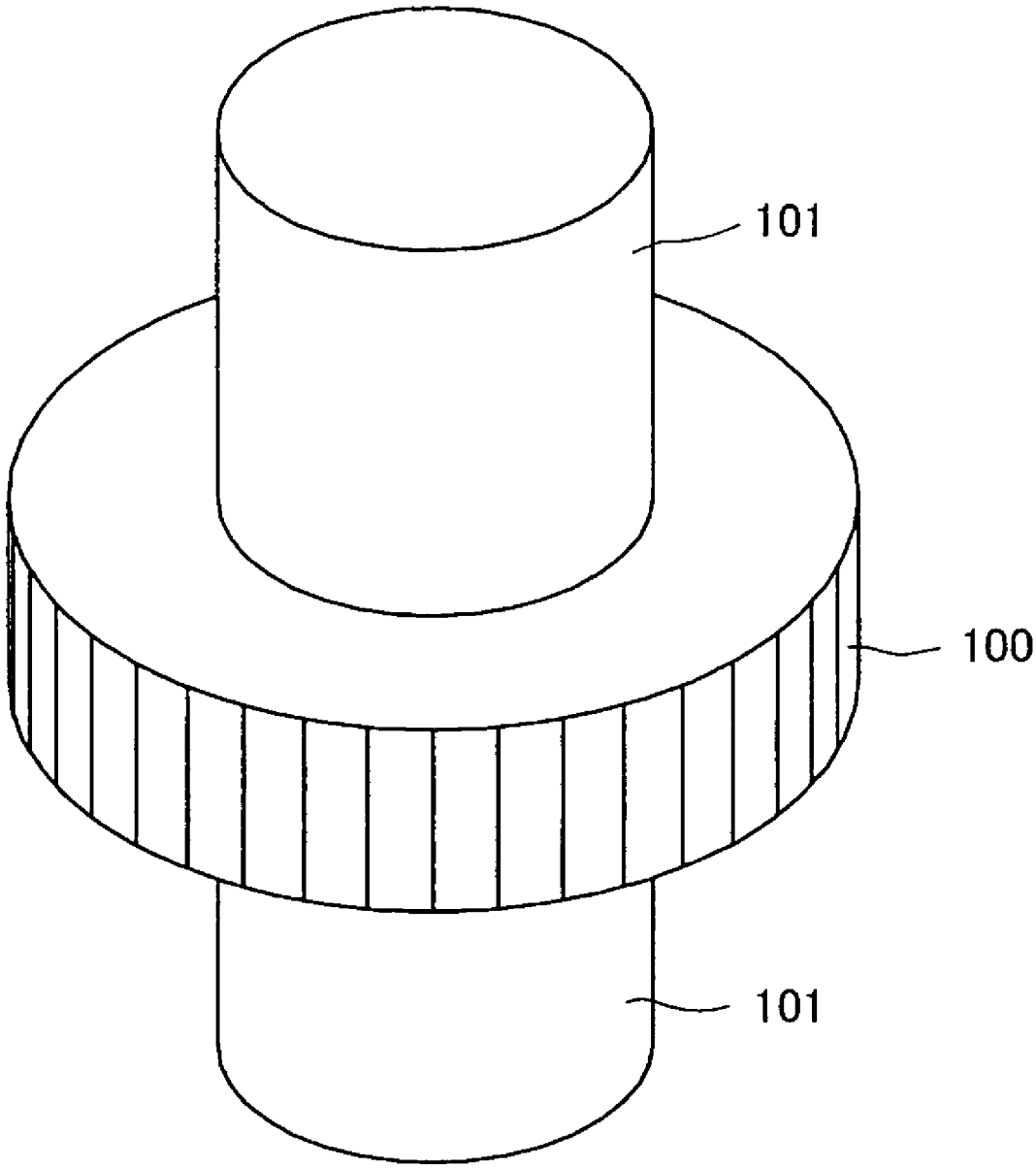
FIG. 13 is a perspective view of a still another modified embodiment of the work.

The above-mentioned embodiment, as shown in FIG. 7, describes a configuration in which a work has a shaft with different diameters according to positions, but the present invention is not limited to this configuration. As shown in FIG. 11, for example, it is possible to execute such a heat treatment to a work having a straight shaft. It is also possible to execute such a heat treatment to works shown in FIGS. 12 and 13.

The invention claimed is:

1. An induction heater for heating a work having a gear portion and a shaft, comprising:

a first heating coil having an arc-shaped portion arranged so as to surround the gear portion; and a second heating coil being arranged so as to face the shaft and having a length in an axial direction of the shaft, and wherein alternating currents of different frequencies are supplied to the first and second heating coils by either separate power sources, or a single power source with the first and second heating coils wired in parallel.

2. The induction heater as defined in claim 1,
wherein the work to be heated has a step.

3. The induction heater as defined in claim 1,
supplying alternating currents of different frequencies to the first heating coil and to the second heating coil.

4. The induction heater as defined in claim 1,
wherein the frequency of the alternating current supplied to the first heating coil and the frequency of the alternating current supplied to the second heating coil are different enough to suppress vibration caused by interference.

5. The induction heater as defined in claim 1,
the first heating coil being an annular coil.

6. The induction heater as defined in claim 1,
the second heating coil having a plurality of linear parts and a connecting part connecting the linear parts in series by their ends, the linear parts being either straight or lightning-shaped.

7. The induction heater as defined in claim 6,
wherein the work to be heated has a step,
wherein the connecting part of the second heating coil is of an arc shape and is arranged so as to come opposite the step.

8. The induction heater as defined in claim 7,
wherein the connecting part has a quadrangular cross section and includes a planar face facing to a corner at the back of the step.

9. The induction heater as defined in claim 7,
wherein the linear parts of the second heating coil each have a quadrangular cross section and the connecting part of the second heating coil has a quadrangular cross section and is twisted relative to the linear parts.

10. The induction heater as defined in claim 1,
further comprising a rotating means for rotating the work.

11. An induction heater for a work having a gear portion and a stepped shaft, comprising:
an annular coil surrounding the gear portion; and
a linear coil arranged to face the stepped shaft in an axial direction, and
wherein alternating currents of different frequencies are supplied to the annular coil and to the linear coil by either separate power sources, or a single power source with the first and second heating coils wired in parallel.

12. The induction heater as defined in claim 11,
wherein a part of the linear coil is arranged to face a boundary between the shaft and the gear portion.

13. An induction heating method for a work having a gear portion and a stepped shaft, comprising the step of using the induction heater as defined in claim 11 so as to connect a hardened pattern of the gear portion by the annular coil and a hardened pattern of the stepped shaft by the linear coil.

14. An induction heater for heating a work having a gear portion, a shaft, and a step between the gear portion and the shaft, comprising:
a first heating coil of an annular shape and arranged so as to surround the gear portion; and
a second heating coil being arranged so as to face the shaft and having a length in an axial direction of the shaft,
wherein the first heating coil is an annular coil,
wherein the second heating coil has a plurality of linear parts and a connecting part connecting the linear parts in series by their ends, the linear parts being either straight or lightning-shaped, the connecting part being of an arc shape and being arranged so as to come opposite the step, and
being adapted to supply a high-frequency current simultaneously to the first and second heating coils,
wherein a frequency of the high-frequency current supplied to the first heating coil and a frequency of the high-frequency current supplied to the second heating coil are different enough to suppress vibration caused by interference.

15. The induction heater as defined in claim 14,
wherein the connecting part has a quadrangular cross section and includes a planar face facing to a corner at the back of the step.

16. The induction heater as defined in claim 14,
wherein the linear parts of the second heating coil each have a quadrangular cross section and the connecting part of the second heating coil has a quadrangular cross section and is twisted relative to the linear parts so that a planar face of the connecting part faces to a corner at the back of the step.

* * * * *